US006929466B1

(12) United States Patent
Reese

(10) Patent No.: US 6,929,466 B1
(45) Date of Patent: Aug. 16, 2005

(54) ELEVATED CANDLE LIGHTER

(76) Inventor: Elvira Reese, 2044 University Park Dr., Sacramento, CA (US) 95825

( * ) Notice: Subject to any disclaimer, the term of this patent is extended or adjusted under 35 U.S.C. 154(b) by 0 days.

(21) Appl. No.: 10/816,473

(22) Filed: Mar. 31, 2004

(51) Int. Cl.[7] ..... F23Q 2/36

(52) U.S. Cl. ..... 431/143; 431/152; 431/344; 431/255

(58) Field of Search ..... 431/143, 142, 431/144, 149, 152, 254, 255, 153, 344, 345

(56) References Cited

U.S. PATENT DOCUMENTS

| | | | | |
|---|---|---|---|---|
| 1,235,465 | A * | 7/1917 | Hage | 431/144 |
| 3,905,750 | A * | 9/1975 | Sell | 431/142 |
| 3,985,492 | A * | 10/1976 | Nunemaker | 431/144 |
| 4,222,734 | A * | 9/1980 | Nolf | 431/156 |
| 4,424,018 | A * | 1/1984 | Lowther, Sr. | 431/288 |
| 4,919,111 | A * | 4/1990 | Ohsawa | 126/25 B |
| 5,003,442 | A * | 3/1991 | Gallo et al. | 362/225 |
| 5,697,775 | A * | 12/1997 | Saito et al. | 431/153 |
| 6,099,300 | A * | 8/2000 | Rice | 431/255 |

FOREIGN PATENT DOCUMENTS

JP 9-53821 A * 2/1997

* cited by examiner

*Primary Examiner*—Josiah C. Cocks
(74) *Attorney, Agent, or Firm*—Risto A. Rinne, Jr.

(57) ABSTRACT

An apparatus for the lighting of a candle that is elevated above a user includes a main body that has a trigger for releasing a quantity of butane from the main body. A plurality of sections of conduit cooperate with each other sufficient to telescope or extend from a retracted position into an extended position that is longer than the retracted position. When the trigger is depressed, butane is released from the main body and flows through all of the sections of conduit where it is eventually discharged into the ambient air. The butane is ignited, either by an on-board device or by a match, at a combined distal end of all of the sections of conduit. The sections of conduit provide a variable extensible effective length to the lighter that is adapted for igniting candles that are elevated above a user at varying distances. A candle snuffer is optionally included.

8 Claims, 1 Drawing Sheet

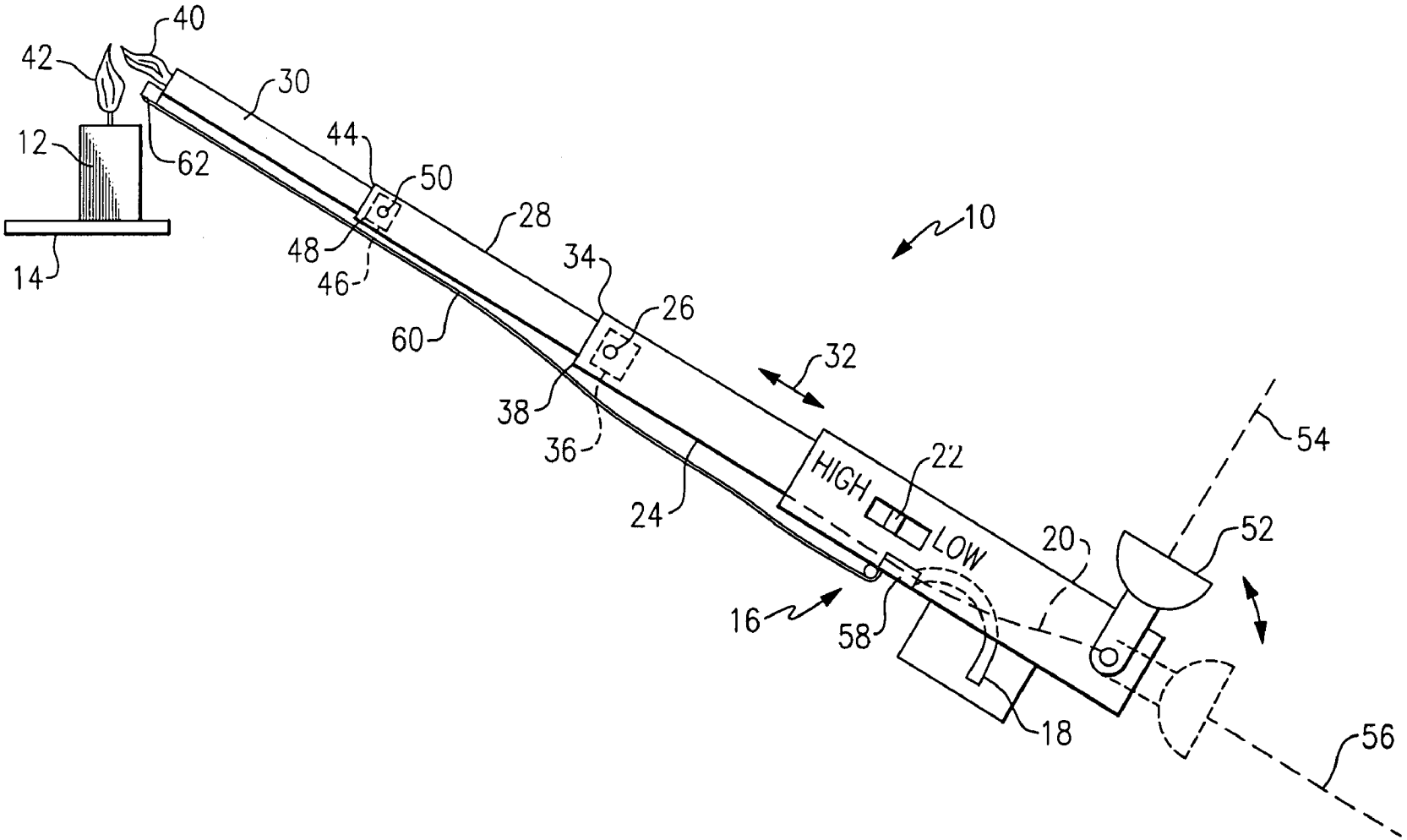
10
12
14
16
18
20
22
HIGH
LOW
24
26
28
30
32
34
36
38
40
42
44
46
48
50
52
54
56
58
60
62

ELEVATED CANDLE LIGHTER

BACKGROUND OF THE INVENTION

1. Field of the Invention

The present invention, in general relates to butane lighters and, more particularly, to a device for lighting and extinguishing candles.

Lighters come in a variety of styles and shapes. Some are intended for lighting cigars and cigarettes while being held near the face. Others are intended to light barbeques, fireplaces, and campfires and include a longer length.

However, there is no lighter than can be used to light candles that are placed at higher elevations, for example, on shelves or ledges. Also, many new homes feature open areas over thresholds that separate one room from another. This is done to provide a more open feeling. These open areas often include a shelf separating the various rooms apart that is disposed several feet above the floor. Plants, candles, or other decorative items are often placed on such types of elevated shelves.

Whenever, a candle is placed high, it is difficult to light. A stepping stool, chair, or step ladder must be used for the person to stand on in order to access the candle, both for lighting and later for extinguishing of the flame.

Adding to the problem is the difficulty that arises from having candles at a variety of elevations. For example, a candle may be a foot or two above a person's reach on a shelf, two or three feet above their reach if placed on a higher shelf, and several feet above their reach if placed on a high shelf as permitted when having a cathedral ceiling or a flat ceiling that is higher than a standard eight foot ceiling.

There is also a trend in new construction for elevated ceilings, again to provide a greater feeling of spaciousness. Ceiling heights of nine feet, ten feet, and higher are becoming increasingly common. These variables have hereto before made a viable solution for lighting candles at various elevations above the head unavailable.

Also, there are times when a person would like to use a butane lighter to ignite an object while being disposed a safe distance away from the object to prevent being burned or singed. One example would be when lighting a gas fired barbeque.

Many gas barbeques do not have functioning igniters to light the propane gas that is commonly used. Therefore, propane gas can accumulate in the basin of the barbeque and, when ignited, can flash, possibly singing a nearby person.

Sometimes, when a charcoal barbeque is used, people use gasoline or other accelerants to ignite the charcoal that can similarly singe a nearby person. It is desirable, at times, to ignite an object, in this example a barbeque, from a safe distance to avoid injury.

Accordingly, there exists today a need for an elevated candle lighter useful for lighting candles when they are located at various elevations above and beyond a person's reach.

Clearly, such an apparatus would be a useful and desirable device.

2. Description of Prior Art

Butane cigarette lighters are, in general, well known. While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide an elevated candle lighter that is useful in lighting candles that are disposed above a person's reach.

It is also an important object of the invention to provide an elevated candle lighter that is useful in lighting candles that are disposed at various elevations above a person's reach.

Another object of the invention is to provide an elevated candle lighter that is easy to use.

Still another object of the invention is to provide an elevated candle lighter that is light in weight.

Still yet another object of the invention is to provide an elevated candle lighter that is safe to use.

Yet another important object of the invention is to provide an elevated candle lighter that can be readily adjusted to reach candles disposed at various elevations.

Still yet another important object of the invention is to provide an elevated candle lighter that is useful in providing a flame that is under a person's control a predetermined distance away from the person.

A first continuing object of the invention is to provide an elevated candle lighter that can also be used to extinguish a candle that is elevated above and beyond a person's reach.

Briefly, an elevated candle lighter that is constructed in accordance with the principles of the present invention has a main body that includes a conventional butane source and controls affecting the flow of butane out of the main body. The butane is channeled out of the main body through an extensible conduit and is combusted at the end of the extensible conduit. A plurality of extensible sections of conduit and a fixed section of conduit are described, along with a method to prevent the sections of conduit from being pulled apart from a position of cooperation with each other. A flame snuffer is disposed at an opposite end as compared to the conduit and is used to extinguish a candle flame that is disposed above and beyond a person's reach.

BRIEF DESCRIPTION OF THE DRAWINGS

The FIGURE is a side view of an elevated candle lighter igniting a candle on a shelf.

DETAILED DESCRIPTION OF THE INVENTION

Referring to the FIGURE is shown, an elevated candle lighter, identified in general by the reference numeral 10.

A candle 12 is disposed on a shelf 14. It is assumed that the shelf is elevated a considerable distance above and beyond the reach of a user (not shown). The user is assumed to be holding and using the elevated candle lighter 10 but is not shown in order to prevent any obstruction of the elevated candle lighter 10.

A main body assembly, identified in general by the reference numeral 16, is similar in design and function to many conventional types of butane lighters (not shown).

A trigger 18 is provided to control the release of butane 20 from inside of the lighter 10. A slide switch 22 is used to vary the rate of flow of butane from the lighter 10 from a small amount to a greater amount or anywhere in between.

The trigger 18 is a momentary switch. If the trigger 18 is not held in a depressed state, no butane 20 is able to flow out from the main body 16 of the lighter 10.

When the trigger 18 is depressed, the rate of flow of butane 20 is determined by the position of the slide switch 22.

A first section of conduit 24 is attached to the main body 16 and does not move relative to it. The first section of conduit 24 can include any preferred cross-sectional shape that is desired, providing it includes an inner conduit path that extends from the main body 16 to a distal end of the first section of conduit 24.

A common cross-sectional shape is circular, although oval or any polygonal shape can also be used for the first section of conduit 24 or for any of the other sections as described hereinbelow.

A second section of conduit 28 includes the same cross-sectional shape as that of the first section of conduit 24, only smaller in size. If the first section of conduit 24 is circular, the second section of conduit 28 includes a smaller diameter.

The remainder of the disclosure is based on a circular cross-sectional shape for the first and the second sections of conduit 24, 28 and also for a third section of conduit 30. If other cross-sectional shapes are used, each section of conduit must have the same shape, only smaller, in accordance with the reasons, as disclosed herein.

The second section of conduit 28 includes an outside diameter that is less than the inside diameter of the first conduit 24, sufficient to permit the second section of conduit 28 to telescope in and out of the first section of conduit 24, as shown by arrow 32.

The first section of conduit 24 includes a first ridge 34 at a distal end thereof. The first ridge 34 provides a narrower diameter for the first section of conduit 24 at the distal end. The second section of conduit 28 must include a small-enough diameter so as to pass through the first ridge 34 as well.

The second section of conduit 28 that is disposed in the first section of conduit 24 closest to the main body 16 includes a larger diameter portion 36 that includes an outside diameter that is greater than the inside diameter of the first ridge 34.

Accordingly, if the second section of conduit 28 is urged (i.e., if it is pulled out by the user) in a direction away from the main body 16, the larger diameter portion 36 of the second section of conduit 28 prevents it from being extended entirely out of a position of cooperation with the first section of conduit 24.

A first seal 38 is provided over the second section of conduit 28 adjacent to the larger diameter portion 36. The first seal 38 is formed of an elastomer or soft plastic, etc. In use, the second section of conduit 28 is extended out of the first section of conduit 24 fully until the first seal 38 contacts the first ridge 34, thereby forming a seal intermediate the first ridge 34 at the distal end of the first section of conduit 24 and at the beginning of the larger diameter portion 36 of the second section of conduit 28.

This is desirable because, during use, the butane 20 that exits from the main body 16 enters into the first section of conduit 24. The butane 20 then passes through the first section of conduit 24, exits there from, and enters into the second section of conduit 28. The first seal 34 ensures that either none or a negligible amount of the butane 20 is able to leak out proximate the first ridge 34. This makes the lighter 10 safer to use.

The first section of conduit 24 preferably includes a raised protrusion 26 that is adapted to engage in a detent in the second section of conduit 28. This helps ensure that proper extension of the second section of conduit 28 out of the first section of conduit 24 has occurred.

Accordingly, the second section of conduit 28 is adapted to telescope in and out of the first section of conduit 24 from a retracted position, in which the larger diameter portion 36 is proximate the main body 16 to an extended position, in which the larger diameter portion is proximate the first ridge 34.

Having one section of conduit (i.e., the second section of conduit 28) that is adapted to telescope in and out of the first section of conduit 24 provides a basic embodiment of the elevated candle lighter 10.

To reach the candle 12 that is elevated above the user, the second section of conduit 28 is grasped and pulled away from the main body 16 until it is fully in the extended position. The trigger 18 is then depressed and after a moment (to allow the butane to reach the end of the second section 28), a match (not shown) is held at the end of the second section to ignite the butane 20 that is escaping.

This produces a first flame 40 that can be used to ignite the wick of the candle 12 sufficient to produce a second flame 42. An alternate way of igniting the butane 20 is described hereinafter.

As desired, the third section of conduit 30 can similarly be included and the third section of conduit 30 and the second section of conduit 28 constructed in like manner to that previously described so as to allow additional extensible capabilities for the elevated candle lighter 10.

The third section of conduit 30 would, of course, include a smaller outside diameter than the inside diameter of a second ridge 44. If the third section of conduit 30 is included, a second larger diameter portion 46 is provided at an end thereof nearest the main body 16 along with a second seal 48. An optional second protrusion 50 is provided in a distal end of the second section of conduit 28 along with a second detent in the third section of conduit 30.

The third section of conduit 30 is thereby able to telescope in an out of the second section of conduit 28 similar to the manner by which the second section of conduit 28 telescopes in and out of the first section of conduit 24.

Accordingly, the first flame 40 is extended an even further distance away from the main body 16 when the third section of conduit 30 is included.

As many additional sections of conduit (not shown) are included with the extended candle lighter 10 as is desired. Different models may include different extension capabilities, as desired.

The main body 16 preferably includes a pivoting snuffer 52 as shown in a first position in which a longitudinal axis 54 thereof is perpendicular with respect to a longitudinal axis 56 of the main body 16.

The snuffer 52 is adapted to pivot into a second position (shown in dashed lines) in which a longitudinal axis 54 thereof is parallel with respect to the longitudinal axis 56 of the main body 16.

To extinguish the candle 12, the first position for the snuffer 52 is most commonly used. The second and third sections of conduit 28, 30 are extended and the furthermost extended section (i.e., the third section of conduit 30) is grasped by the user. The user then places the snuffer 52 over the second flame 42 for a period of time and in close enough proximity sufficient to extinguish the second flame 42. Afterwards, the snuffer 52 is removed from the candle 12 and the second and third sections of conduit 28, 30 are retracted, as desired.

An alternate method for igniting the butane 20 includes a piezoelectric device 58 inside the main body 16 that is activated by depressing the trigger 18. The trigger 18, when the piezoelectric device 58 is used, compresses the piezoelectric device sufficient to produce an electrical potential while simultaneously releasing a quantity of the butane 20.

A slow and partial depressing of the trigger 18 first releases a sufficient quantity of the butane so that when an arc is produced, as described below, a sufficient quantity of butane 20 to be ignited has already reached the end of the most extended section of conduit (i.e., the end of the third section of conduit 30).

A wire 60 extends from the piezoelectric device 58 to an electrode 62 that is disposed at the end of the third section of conduit 30 (i.e., the last extensible section of conduit that is provided). The electrode 62 is attached to the third section of conduit 30 and is electrically insulated therefrom.

Partial depression of the trigger 18 releases the butane 20. Complete depression of the trigger 18, which is momentarily delayed by the user, activates the piezoelectric device 58 sufficient to produce an electrical arc from the electrode 62 to the third section 30 after the butane 20 has reached the area of the electrode 62.

The third section of conduit 30 is electrically connected to the second section of conduit 28 which, in turn, is electrically connected to the first section of conduit 24 which is electrically connected within the main body 16 to the piezoelectric device 58. This completes an electrical circuit.

The arc ignites the butane 20 which produces the first flame 40, thereby eliminating the need to use a match to ignite the butane 20. The wire 60 extends into a nearly linear and parallel arrangement with respect to the sections of conduit 24, 28, 30 when the extensible sections 28, 30 are fully extended, and forms a small loop (not shown) when they are retracted. If desired, a reel (not shown) that is spring loaded could be attached to an exterior of the lighter 10 and used to supply tension to the wire 62 sufficient to retract (i.e., reel up) any excess of the wire 60 when the extensible sections 28, 30 are retracted.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An elevated candle lighter, comprising:

(a) a main body that includes a source of combustible fuel and wherein said combustible fuel includes butane, and means for controlling the release of said fuel from said main body, and (b) extensible conduit means adapted for directing a flow of said combustible fuel, said extensible conduit means attached to said main body; and wherein said extensible conduit means includes a first section of conduit rigidly attached to said main body and a second section of conduit that is adapted to cooperate with said first section of conduit sufficient to extend from a first retracted position into a second extended position and wherein said overall length of said extensible conduit means is greater in said second extended position than in said first retracted position and wherein said second section of conduit is adapted to telescope with respect to said first section of conduit from said first retracted position into said second extended position and wherein said combustible fuel is adapted to flow from said main body and through all of said extensible conduit; and including means for igniting said combustible fuel, said means for igniting attached to said lighter; and wherein said means for igniting said combustible fuel includes means for igniting said combustible fuel at a distal end of said extensible conduit means; and including a snuffer attached to said lighter and wherein said snuffer is attached to said main body at an end of said main body that is disposed distally away from said extensible means, and wherein said snuffer is adapted to pivot intermediate a first position in which a longitudinal axis of said snuffer is perpendicular to a longitudinal axis of said main body into a second position in which said longitudinal axis of said snuffer is parallel to said longitudinal axis of said main body.

2. The elevated candle lighter of claim 1 wherein said second section of conduit includes an outside dimension that is less than an inside dimension of said first section of conduit sufficient to permit a portion of said second section of conduit to retract inside said first section of conduit.

3. The elevated candle lighter of claim 1 including at least one additional section of conduit that is adapted to telescope with respect to said second section of conduit.

4. The elevated candle lighter of claim 3 wherein said at least one additional section of conduit includes a third section of conduit.

5. The elevated candle lighter of claim 1 wherein said means for controlling the release of fuel from said main body includes a trigger and wherein said fuel is adapted to be released from said main body subsequent to a depression of said trigger and wherein said fuel is not adapted to be released from said main body when said trigger is not depressed.

6. The elevated candle lighter of claim 5 including means for controlling the rate of flow that said combustible fuel is released from said main body when said trigger is depressed.

7. The elevated candle lighter of claim 1 wherein said means for igniting includes a piezoelectric device attached to said lighter and means for producing an arc at said distal end.

8. The elevated candle lighter of claim 1 including means for providing a seal intermediate said first section of conduit and said second section of conduit sufficient to prevent a quantity of said fuel from escaping from said lighter proximate said means for providing a seal.

* * * * *